United States Patent [19]

Budnik

[11] Patent Number: 4,924,262

[45] Date of Patent: May 8, 1990

[54] SHUTTER CALIBRATION AND DOCUMENT SIZE DETECTION

[75] Inventor: Roger W. Budnik, Williamson, N.Y.

[73] Assignee: Xerox Corporation, Stamford, Conn.

[21] Appl. No.: 369,876

[22] Filed: Jun. 22, 1989

[51] Int. Cl.[5] ..... G03G 15/00

[52] U.S. Cl. ..... 355/75; 355/309; 355/311; 355/316; 356/400; 250/206; 271/265

[58] Field of Search ..... 355/311, 309, 316, 317, 355/321, 75, 76, 61; 356/400; 250/556, 557, 560, 571, 206; 271/265

[56] References Cited

U.S. PATENT DOCUMENTS

| | | | |
|---|---|---|---|
| 4,456,372 | 6/1984 | Yamauchi | 355/75 |
| 4,568,812 | 2/1986 | Nishiyama | 355/75 |
| 4,585,332 | 4/1986 | Shenoy | 355/311 X |
| 4,614,874 | 9/1986 | Fukuda et al. | 355/75 X |
| 4,620,781 | 11/1986 | Miyamoto | 355/75 X |
| 4,659,214 | 4/1987 | Takemura et al. | 355/75 |
| 4,692,019 | 9/1987 | Morimoto et al. | 355/75 X |
| 4,702,589 | 10/1987 | Ito | 355/311 X |
| 4,713,550 | 12/1987 | Anzai et al. | 250/560 |
| 4,740,811 | 4/1988 | Watanabe | 355/311 X |
| 4,749,872 | 6/1988 | Asada et al. | 355/75 X |
| 4,823,165 | 4/1989 | Narukawa et al. | 355/75 |
| 4,855,787 | 8/1989 | Hashimoto et al. | 355/311 |

*Primary Examiner*—A. C. Prescott

*Attorney, Agent, or Firm*—H. Fleischer; J. E. Beck; R. Zibelli

[57] ABSTRACT

An apparatus in which shutters used to occlude the region of the platen not supporting the original document being reproduced are calibrated. After the fully open position of the shutters is determined, the size of each original document being reproduced may be determined. In calibrating the shutters, an original document having a predetermined size is positioned on the platen with one set of perpendicular edges thereof being located at a registration position. The shutters are moved from the fully open position to another set of perpendicular edges of the document. The distance that the shutters move between the open position and the edges of the document is measured. With this information, the distance between the open position and the registration position may be determined as a function of the size of the original document and the distance that the shutters move. After the location of the open position of the shutters has been calibrated, the size of other original documents may be determined. The original document of unknown size is positioned with one set of perpendicular edges thereof located at the registration position on the platen. The shutter is moved from the open position to the other set of perpendicular edges of the original document. The distance that the shutter moves from the open position to the edges of the document is measured and the size of the document calculated as a function of the shutter distance moved and the calibrated distance between the open position and the registration position.

28 Claims, 3 Drawing Sheets

SHUTTER CALIBRATION AND DOCUMENT SIZE DETECTION

This invention relates generally to an electrophotographic printing machine, and more particularly concerns an apparatus for detecting the size of an original document being reproduced thereon and calibrating shutters used therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In reproducing an original document, the size of the document is detected and a copy sheet of appropriate size selected corresponding thereto. Thus, the copying machine selects the appropriate size copy sheet depending upon the size of the original document and the reduction/magnification selected. Hereinbefore, the size of an original document placed on a platen of a printing machine was detected by a combination of light emitting devices and photodetectors. The photodetectors are arranged to receive light reflected from the original document and to determine the size of the original document based on the conditions detected by the photodetectors.

The platen supporting the original document is a substantially planar, transparent member. Portions of the platen extend beyond the side edges of the original document. When the original document is exposed, light rays are transmitted through the platen in those regions not supporting the original document. In order to discharge the photoconductive surface in those regions, the platen cover has a light reflective surface thereon which reflects the light rays transmitted through the platen back onto the charged border regions of the photoconductive surface surrounding the latent image corresponding to the original document. Shutters are used to block the regions of the platen extending beyond the sides of the original document. The shutters move from a fully open position to a position adjacent the sides of the original document. In this way, the shutters prevent light rays from passing through the platen and reflect the light rays back onto the charged border regions of the photoconductive surface. This discharges the border regions. Hereinbefore, the shutters have been calibrated manually. This method consisted of placing a scale across the platen in one direction, manually moving a shutter across the home sensor until the location of the trigger point was identified and measuring the distance between the home sensor trigger point and the location of the registration position for the original document on the platen. This procedure was then repeated for the other shutter. This information was then stored in the non-volatile memory of the printing machine. After calibrating the shutters, an accurate measurement of the original document's length and width may be obtained. This information is then used for automatic reduction/enlargement, edge fadeout, and automatic selection of the size of the image to fit onto the copy sheet. The previous method of manually calibrating the shutters was very tedious and time consuming. Preferably, it is desirable to automatically calibrate both shutters and use this information to determine the size of the original document. The following disclosures appear to be relevant:

U.S. Pat. No. 4,456,372. Patentee: Yamauchi. Issued: June 26, 1984.

U.S. Pat. No. 4,568,181. Patentee: Nishiyama. Issued: February 4, 1986.

U.S. Pat. No. 4,713,550. Patentee: Ansai et al. Issued: December 15, 1987.

The relevant portions of the foregoing patents may be summarized as follows:

U.S. Pat. No. 4,456,372 discloses an electrophotographic printing machine having a document size detecting device for determining the size of a document by comparing the output signal from the detecting device to standard document size data stored in the memory of the printing machine. The detecting device includes a sensor bar mounted rotatably beneath a glass plate supporting the document. A reflection type optical sensor is located on the upper surface of one end of the sensor bar. A document size signal is generated corresponding to the comparison between the signal from the sensor and the stored document size data in the memory to automatically select the appropriate size copy sheet.

U.S. Pat. No. 4,568,181 describes a plurality of light emitting and light receiving sensors positioned discretely on the document table adapted to support the original document. When the original document is positioned on the document table, the original document, depending upon its size, blocks the reflection of light rays onto some of the receiving sensors. A control circuit calculates the size of the original document depending upon which sensors are blocked.

U.S. Pat. No. 4,713,550 discloses a plurality of light emitting diodes located at discrete intervals along a table supporting an original document. Each light emitting diode has a corresponding photodiode adapted to receive light rays therefrom reflected thereto. The output from the photodiodes is compared to a reference and, depending upon the signal level, the size of the original document is calculated.

In accordance with one aspect of the present invention, there is provided an apparatus for determining the size of a document. The apparatus includes a platen for supporting the document so that one set of perpendicular edges thereof are located at a registration position thereon. A shutter is located in an open position with the distance between the open position and the registration position being stored as constant. The shutter is adapted to move from the open position to another set of perpendicular edges of the document. Means are provided for measuring the distance that the shutter moves between the open position and the other set of perpendicular edges of the document. Mean calculate the size of the document as a function of the distance that the shutter moves and the constant corresponding to the distance between the open position and the registration position.

Pursuant to another aspect of the features of the present invention, there is provided an electrophotographic printing machine of the type having a photoconductive member and a plurality of processing stations for reproducing a copy of an original document positioned so that one set of perpendicular edges thereof are located at a registration position thereon. The improvement comprises means for determining the size of the original document. The determining means includes a shutter located at a open position with the distance between the open position and the registration position being stored as constant. The shutter is adapted to move from the open position to another set of perpendicular edges of the original document. Means are provided for determining the distance between the registration position and the open position to calibrate the shutters and storing this information as a constant. Means measure the distance that the shutter moves between the open position and the other set of perpendicular edges of the original document. Mean calculate the size of the original document as a function of the distance that the shutter moves and the constant corresponding to distance between the open position and the registration position.

Still another aspect of the present invention is a method of determining the size of an original document positioned so that one set of perpendicular edges thereof are located at a registration position on a platen. The method includes the steps of determining the distance between the registration position and a open position to calibrate the shutters and storing this information as a constant. The shutter is moved from the open position to another set of perpendicular edges of the document. The distance that the shutter moves from the open position to the edges of the document is measured. The size of the document is calculated as a function of the distance measured during the step of measuring and a constant corresponding to the distance from the registration position on the platen to the open position.

A final aspect of the present invention is a method of calibrating a shutter mounted movably on a platen adapted to support an original document thereon. The method includes the steps of positioning an original document having a predetermined size on the platen so that one set of perpendicular edges thereof are located at a registration position. The shutter is moved from a open position to another set of perpendicular edges of the document. The distance that the shutter moves between the open position and the edges of the document is measured. The distance between the open position and the registration position of the original document is calculated as a function of the distance measured during the step of measuring and the size of the original document.

Other aspects of the present invention will become apparent as the following description proceeds and upon reference to the drawings, in which:

FIG. 3(*b*) shows the FIG. 2 shutters in the closed position;

FIG. 3(*c*) shows the FIG. 2 shutters in the document detecting position.

While the present invention will hereinafter be described in connection with a preferred embodiment and method, it will be understood that it is not intended to limit the invention to that embodiment and method. On the contrary, it is intended to cover all alternatives, modifications, and equivalents, as may be included within the spirit and scope of the invention as defined by the appended claims.

Figure 1:
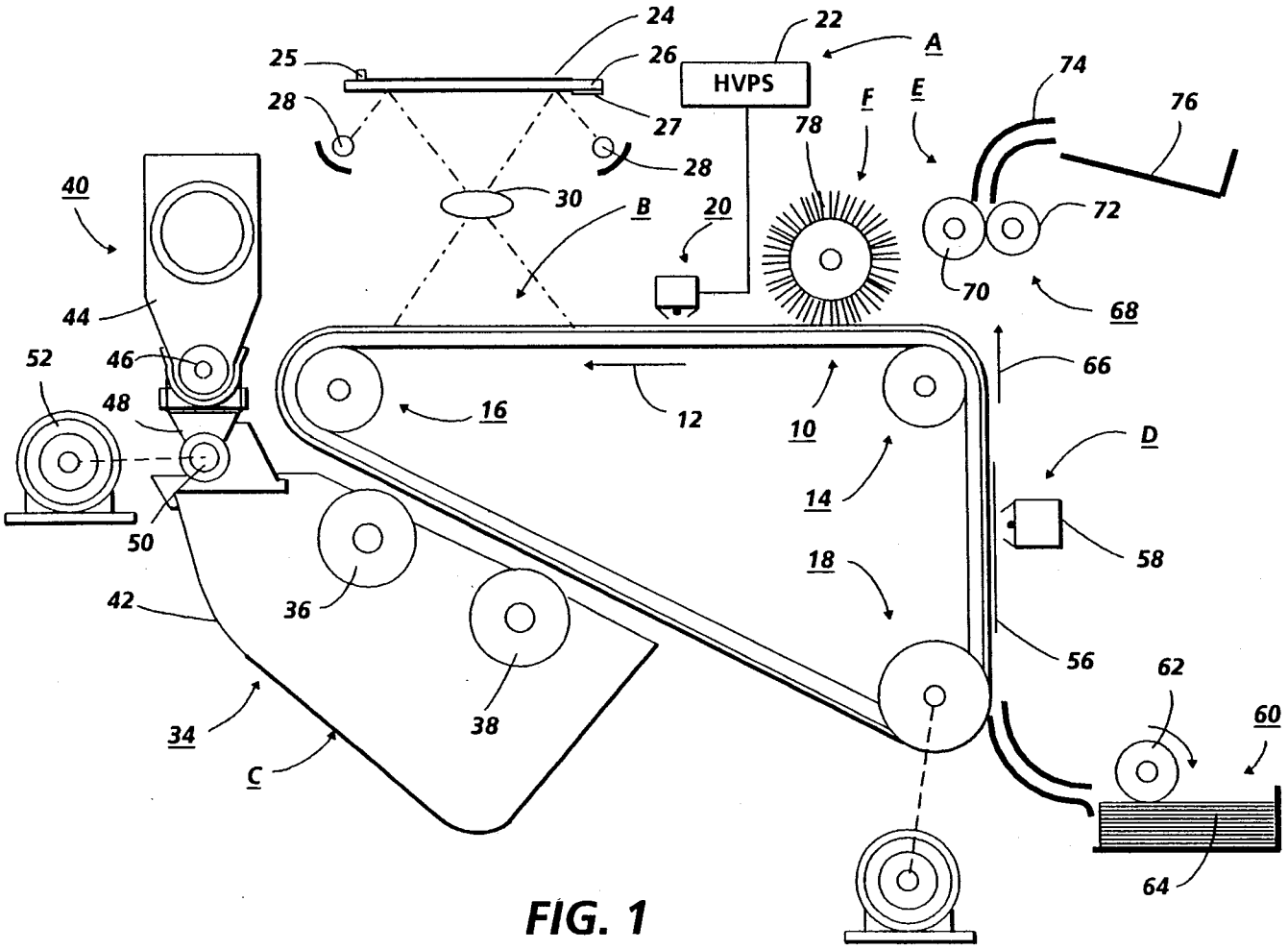
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the present invention may be employed in a wide variety of printing machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 20. Stripping roller 14 is mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, a corona generating device, indicated generally by the reference numeral 20, charges the photoconductive belt 10 to a relatively high, substantially uniform potential. Corona generating device 20 includes a generally U-shaped shield and a charging electrode. A high voltage power supply 22 is coupled to the shield. A change in the output of power supply 22 causes corona generating device 20 to vary the charge applied to the photoconductive belt 10.

Next, the charged portion of the photoconductive surface is advanced through imaging station B. At imaging station B, an original document 24 is positioned face down upon a transparent platen 26. One corner of document 24 is located in contact with registration guide 25.

Thus, mutually perpendicular side edges of original document 24 engage registration guide 25 so as to be positioned on platen 26 at a preselected location. Shutters, indicated generally by the reference numeral 27 move from the home position until the lead edge thereof detects the opposed side edges of the original document. The shutters block the platen in the clear portions, i.e. those regions of the platen extending beyond the original document. Further details of the operation of shutters 27 will be described hereinafter with reference to FIGS. 2 through 4, inclusive. Imaging of a document is achieved by lamps 28 which illuminate the document on platen 26. Light rays reflected from the document are transmitted through lens 30. Lens 30 focuses the light image of the original document onto the charged portion of photoconductive belt 10 to selectively dissipate the charge thereon. This records an electrostatic latent image on the photoconductive belt which corresponds to the informational areas contained within the original document.

At development station C, a magnetic brush development system, indicated generally by the reference numeral 34, advances a developer material into contact with the electrostatic latent image and test patch recorded on photoconductive belt 10. Preferably, magnetic brush development system 34 includes two magnetic brush developer rollers 36 and 38. These rollers each advance the developer material into contact with the latent image and test areas. Each developer roller forms a brush comprising carrier granules and toner particles. The latent image attracts the toner particles from the carrier granules forming a toner powder image on the latent image. As toner particles are depleted from the developer material, a toner particle dispenser, indicated generally by the reference numeral 40, furnishes additional toner particles to housing 42 for subsequent use by developer rollers 36 and 38, respectively. Toner particle dispenser 40 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that toner particles are dispensed from the apertures therein. After development, the toner powder image is advanced to transfer station D.

At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute 54. Chute 54 guides the advancing sheet from stack 64 into contact with the photoconductive belt in a timed sequence so that the toner powder image developed thereon contacts the advancing sheet at transfer station D. At transfer station D, a corona generating device 58 sprays ions onto the backside of sheet 56. This attracts the toner powder image from photoconductive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74, guides the advancing sheet 56 to catch tray 76 for subsequent removal from the printing machine by the operator.

After the copy sheet is separated from photoconductive belt 10, the residual toner particles and the toner particles adhering to the test patch are cleaned from photoconductive belt 10. These particles are removed from photoconductive belt 10 at cleaning station F. Cleaning station F includes a rotatably mounted fiberous brush 78 in contact with photoconductive belt 10. The particles are cleaned from photoconductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
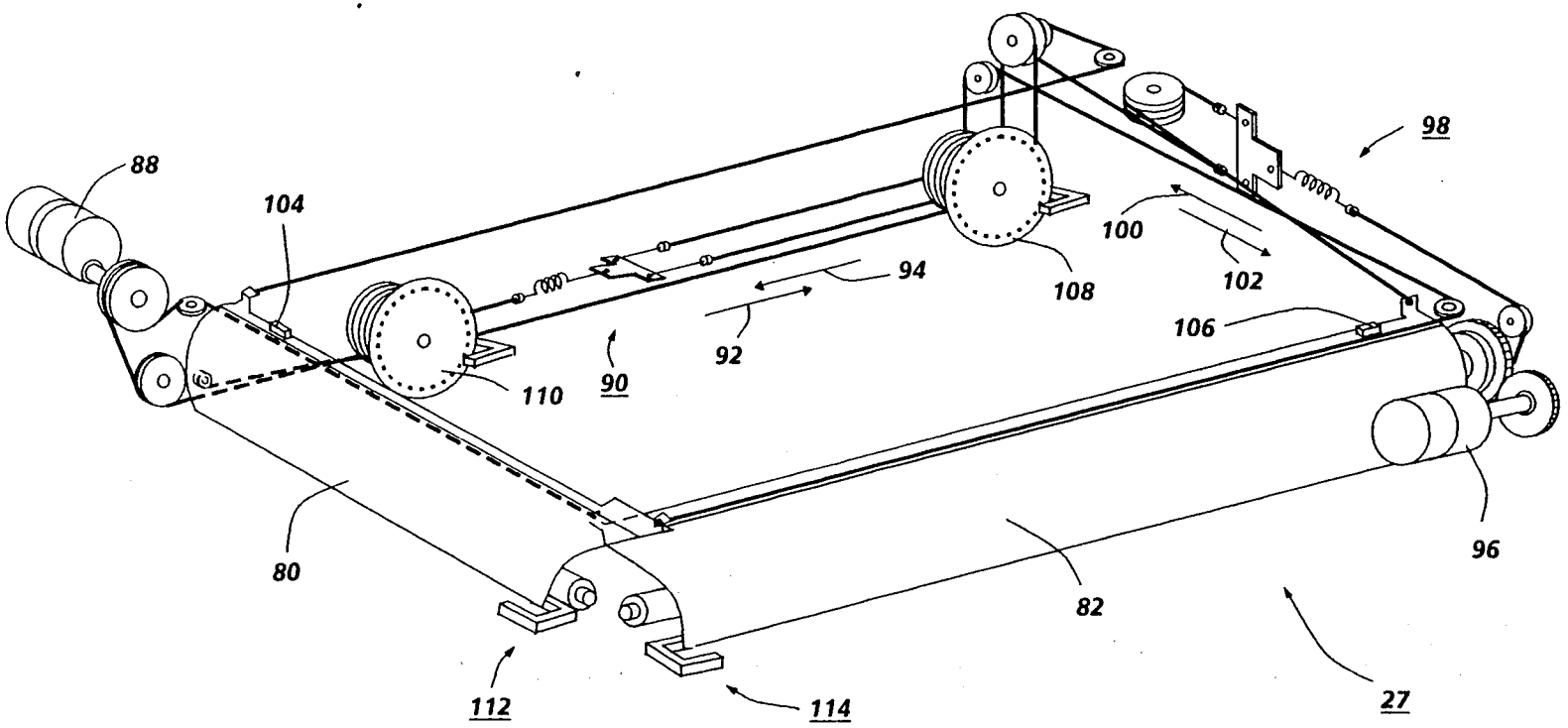
FIG. 2 is a schematic elevational view showing the operation of the shutters used in the FIG. 1 printing machine.

Referring now to FIG. 2, the details of shutter 27 are depicted thereat. Shutter 27 includes a front shutter 80 and a side shutter 82. Front shutter 80 and side shutter 82 are made from a flexible, opaque sheet. Front shutter 80 is wrapped about front roll 84 with side shutter 82 being wrapped about side roll 86. Front motor 88 drives front shutter 80 by rotating front roll 84 and the associated front cable system, indicated generally by the reference numeral 90. Front motor 88 rotates in a clockwise and counter clockwise direction so as to move front shutter 80 in the direction of arrows 92 and 94. In this way, front shutter 80 is advanced across platen 26 (FIG. 1), in the direction of arrow 92, so as to position the leading edge thereof adjacent the front edge of original document 24 (FIG. 1). Alternatively, front shutter 80 is advanced across platen 26 (FIG. 1), in the direction of arrow 94, so as to position the leading edge thereof at the full open position. Side shutter 82 operates in a similar manner. Side motor 96 drives side shutter 82 by rotating side roll 86 and the associated side cable system, indicated generally by the reference numeral 98. Side motor 96 rotates in a clockwise and counter clockwise direction so as to move side shutter 82 in the direction of arrows 100 and 102. In this way, side shutter 82 is advanced across platen 26 (FIG. 1), in the direction of arrow 100, so as to position the leading edge thereof adjacent a side edge of original document 24 (FIG. 1) perpendicular to the front edge. Alternatively, side shutter 86 is advanced across platen 26 (FIG. 1), in the direction of arrow 102, so as to position the leading edge thereof at the full open position. Front document sensor 104 is mounted on the leading edge of front shutter 80. Front document sensor 104 includes a light emitting diode and a photodiode. As front shutter 80 is advanced across platen 26 on the underside thereof in the direction of arrow 92, i.e. the side opposed to the side supporting original document 24, light rays from the light emitting diode are reflected to the photodiode and the output therefrom remains at a substantially constant level. When the light leading edge of front shutter 80 is adjacent the front edge of original document 24, the light rays from the light emitting diode are reflected from the original document and the output from the photodiode changes levels. At this time, front motor 88 is de-energized and the leading edge of front shutter 80 is adjacent the front edge of original document 24. Side document sensor 106 is mounted on the leading edge of side shutter 80. Side document sensor 106 also includes a light emitting diode and a photodiode. As side shutter 82 is advanced across platen 26 on the underside thereof in the direction of arrow 100, i.e. the side opposed to the side supporting original document 24, light rays from the light emitting diode are reflected to the photodiode and the output therefrom remains at a substantially constant level. When the light leading edge of side shutter 82 is adjacent the front edge of original document 24, the light rays from the light emitting diode are reflected from the original document and the output from the photodiode changes levels. At this time, side motor 96 is de-energized and the leading edge of side shutter 96 is adjacent the side edge of original document 24. When the leading edges of front shutter 80 and side shutter 82 are adjacent the mutually perpendicular front and side edges of original document 24, the regions of platen 26 extending outwardly therefrom are covered by the shutters and opaque. The shutters are made from flexible sheets which are light reflective. In this way, during exposure of the original document, the charged border regions extending beyond regions of the latent image corresponding to the original document are discharged so as eliminate shadows or black borders on the copy sheet. A front shutter clock sensor 108 monitors the distance that the front shutter moves. Clock sensor 108 has a disc with a plurality of equally spaced holes about a circle thereon. A light emitting diode is located on one side of the disc and a photodiode on the other side thereof. The disc rotates as the front shutter moves in the direction of arrows 92 and 94. As each hole passes between the light emitting diode and the photodiode, a pulse is generated corresponding to the change in state of the photodiode, i.e. from not receiving light rays to receiving light rays. A circuit is coupled to the photodiode which counts the number of pulses. The number of pulses counted corresponds to the distance that the front shutter has moved. The absolute distance is determined by amplifying the count by the appropriate constant scale factor. The distance that the side shutter moves is determined in substantially the same manner. A side shutter clock sensor 110 monitors the distance that the side shutter moves. Clock sensor 110 has a disc with a plurality of equally spaced holes about a circle thereon. A light emitting diode is located on one side of the disc and a photodiode on the other side thereof. The disc rotates as the side shutter moves in the direction of arrows 100 and 102. As each hole passes between the light emitting diode and the photodiode, a pulse is generated corresponding to the change in state of the photodiode, i.e. from not receiving light rays to receiving light rays. A circuit is coupled to the photodiode which counts the number of pulses. The number of pulses counted corresponds to the distance that the side shutter has moved. The absolute distance is determined by amplifying the count by the appropriate constant scale factor. The shutters are also located in the fully open position. This location is determined by the front and side open position sensors. Front open position sensor 112 includes a light emitting diode and a photodiode. The front open position sensor is located so that when the leading edge of the front shutter is positioned thereat, the front shutter is fully opened. The flexible sheet of the front shutter is interposed between the light emitting diode and the photodiode of front open position sensor 112. As front shutter 80 moves in the direction of arrow 94, the flexible sheet is interposed between the light emitting diode and photodiode of sensor 112. The light rays from the light emitting diode are blocked by the flexible sheet and the photodiode remains in a low state. When the leading edge of the flexible sheet passes, the light rays from the light emitting diode are transmitted to the photodiode and the output therefrom changes to a high state. A circuit connects front open position sensor 112 with front motor 88. Motor 88 is de-energized when the signal from the photodiode of the front open position sensor changes from the low state to the high state. This indicates that the front shutter has reached the fully opened position. Side open position sensor 114 includes a light emitting diode and a photodiode. The side open position sensor is located so that when the leading edge of the side shutter is positioned thereat, the side shutter is fully opened. The flexible sheet of the side shutter is interposed between the light emitting diode and the photodiode of side open position sensor 114. As side shutter 82 moves in the direction of arrow 102, the flexible sheet remains interposed between the light emitting diode and photodiode of sensor 114. The light rays from the light emitting diode are blocked by the flexible sheet and the photodiode remains in a low state. When the leading edge of the flexible sheet passes, the light rays from the light emitting diode are transmitted to the photodiode and the output therefrom changes to a high state. A circuit connects side open position sensor 114 with side motor 96. Motor 96 is de-energized when the signal from the photodiode of the side open position sensor changes from the low state to the high state. This indicates that the side shutter has reached the fully opened position.

Figure 3A:
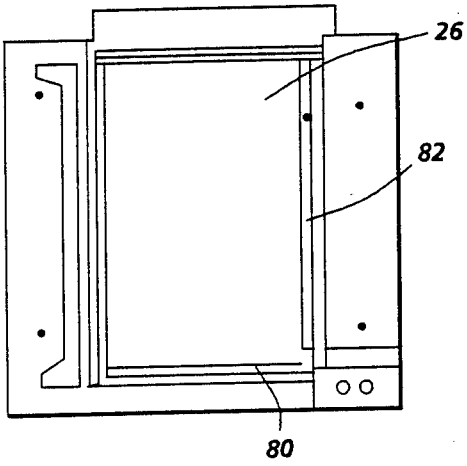
FIG. 3(*a*) shows the FIG. 2 shutters in the full open position.
Figure 3B:
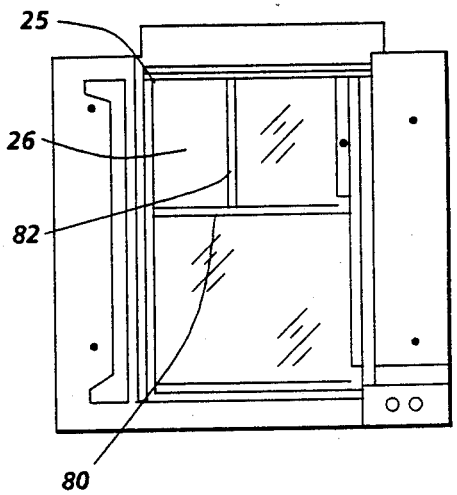
Figure 3C:
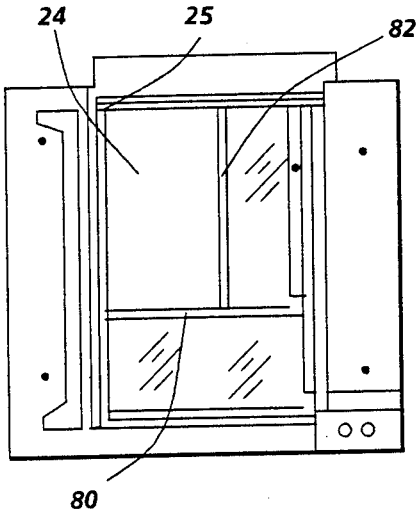

Turning now to FIGS. 3(*a*) through 3(*c*) inclusive, the operation of the front and side shutter are depicted thereat. As shown in FIG. 3(*a*), shutters 80 and 82 are located in the fully open position. In this position, the entire surface of platen 26 is opened. FIG. 3(*b*) shows shutters 82 and 84 covering a portion of platen 26. In operation, the shutters move to the leading edges of the document. The corner of the original document defined by mutually perpendicular back and side edges engages the registration guide 25. The back edge of the document is opposed to the front edge and the side edge engaging the registration guide is perpendicular thereto forming a corner. The registration guide is a corner adapted to receive the corner of the original document. FIG. 3(*c*) shows the shutters 82 and 84 positioned adjacent the front and side edges of the original document 24. The side and back edges of original document 24 are registered against registration guide 25. In operation, the shutters are initially located at the full open position (FIG. 3(*a*)). An original document is positioned on the platen and the shutters move to position the leading edges thereof adjacent the front and side edges of the original document (FIG. 3(*c*)). After the document is removed from the platen, the shutters move to the full open position, as shown in FIG. 3(*a*), and the to the closed position, as shown in FIG. 3(*b*). When the next original document is placed on the platen, the shutters move to the full open position and the shutters move to position the leading edges thereof adjacent the front and side edges of the document. In order to determine the size of the original document being reproduced, it is necessary to determine the location of the front and side position sensors 112 and 114. The method for calibrating these sensors and for determining the size of the original document placed on the platen is described hereafter with reference to FIG. 4.

Figure 4:
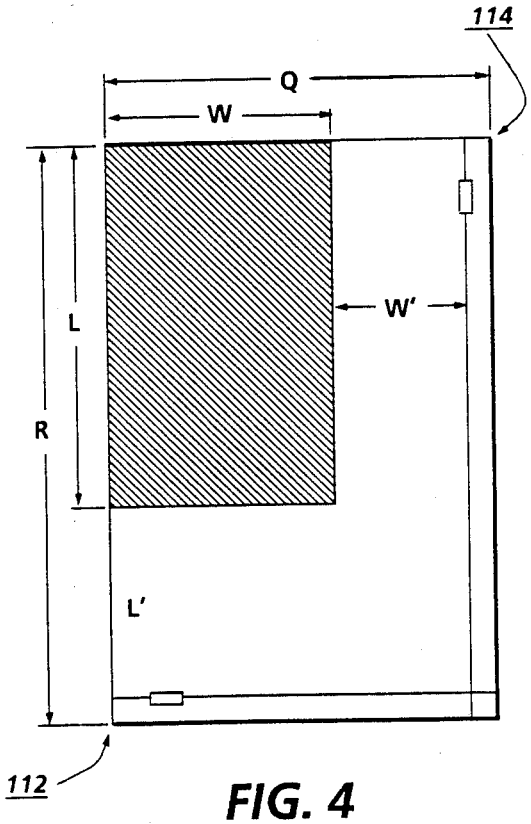
FIG. 4 shows the various measurements required to calibrate the location of the open position and to determine the size of an original document.

Referring now to FIG. 4, in order to calibrate the location of sensors 112 and 114, an original document 24 of predetermined size, i.e. the length, L, and the width, W, are predetermined, is positioned on the platen in registration with registration guide 25. The front shutter advances a distance L' until the front edge thereof is adjacent the front edge of original document 24. The side shutter advances a distance W' until the side edge thereof is adjacent the side edge of original document 24. The distance that the shutters move is determined by clock sensors 108 and 110 (FIG. 1). The distance, R, from the registration guide 25 to front sensor 112 may be determined from the following relationship:

$$R=L+L'$$

The distance, Q, from the registration guide 25 to side sensor 114 may be determined from the following relationship:

$$Q=W+W'$$

Once the distances, R, and Q, between registration guide 25 and front sensor 112 and side sensor 114 are calibrated, the size of an unknown original document may be determined. If an original document 24 having an unknown length, L, and width, W, is positioned on the platen in registration at registration guide 25, the front shutter advance across the platen a distance L', and the side shutter advances a distance W' until the leading edges of the shutter are adjacent the front and side edges of the original document. Clock sensors 108 and 110 measure the distance L' and W'. The document length, L, and width, W, may be determined from the following relationships:

$$L=R-L'$$

$$W=Q-W'$$

In this way, the size of any original document may be readily determined as a function of the distance that the shutter moves from the fully open position to the document detection position in which the leading edges of the shutter are adjacent the front and side edges of the document.

In recapitulation, the printing machine of the present invention employs an apparatus for calibrating shutters used therein, and, based upon the calibration information, determining the size of an original document being reproduced therein.

It is, therefore, evident that there has been provided, in accordance with the present invention, an apparatus and method that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for determining the size of a document, including:

a platen for supporting the document so that one set of perpendicular edges thereof are located at a registration position thereon;

a shutter located in a open position with the distance between the open position and the registration position being stored as a constant, said shutter being adapted to move from the open position to another set of perpendicular edges of the document;

means for measuring the distance that the shutter moves between the open position and the other set of perpendicular edges of the document; and means for calculating the size of the document as a function of the distance that the shutter moves and the constant corresponding to distance between the open position and the registration position.

2. An apparatus according to claim 1, wherein said shutter includes means for sensing the edges of the document.

3. An apparatus according to claim 2, further including means for detecting that said shutter is at the open position.

4. An apparatus according to claim 3, wherein said shutter includes:

a first flexible sheet disposed adjacent said platen and adapted to move thereacross from the open position until an edge thereof is adjacent one edge of the document; and a second flexible sheet disposed adjacent said platen and adapted to move thereacross, in a direction substantially perpendicular to the direction of movement of said first flexible sheet, from the open position until one edge thereof is adjacent the other edge of the document.

5. An apparatus according to claim 4, wherein said measuring means includes;

first means for counting the number of pulses as said first flexible sheet moves from the open position to the edge of the document; and second means for counting the number of pulses as said second flexible sheet moves from the open position to the other edge of the document.

6. An apparatus according to claim 5, further including a registration guide mounted on said platen and adapted to engage mutually perpendicular edges of the document to position the document at the registration position on said platen.

7. An apparatus according to claim 6, wherein said calculating means determines the size of the document as function of the distance that said first flexible sheet and said second flexible sheet move and the constant corresponding to the distance from the open position to said registration guide.

8. An electrophotographic printing machine of the type having a photoconductive member and a plurality of processing stations for reproducing a copy of an original document positioned so that one set of perpendicular edges thereof are located at a registration position thereon, wherein the improvement comprises means for determining the size of the original document, said determining means including:

a shutter located at a open position with the distance between the open position and the registration position being stored as constant, said shutter being adapted to move from the open position to another set of perpendicular edges of the original document;

means for determining the distance between the registration position and the open position to calibrate the shutters and storing this information as a constant;

means for measuring the distance that the shutter moves between the open position and the other set of perpendicular edges of the original document; and means for calculating the size of the original document as a function of the distance that the shutter moves and the constant corresponding to distance between the open position and the registration position.

9. A printing machine according to claim 8, wherein said shutter includes means for sensing the edges of the document.

10. A printing machine according to claim 9, further including means for detecting that said shutter is at the open position.

11. A printing machine according to claim 10, wherein said shutter includes:

a first flexible sheet disposed adjacent said platen and adapted to move thereacross from the open position until an edge thereof is adjacent one edge of the document; and a second flexible sheet disposed adjacent said platen and adapted to move thereacross, in a direction substantially perpendicular to the direction of movement of said first flexible sheet, from the open position until one edge thereof is adjacent the other edge of the document.

12. A printing machine according to claim 11, wherein said measuring means includes;

first means for counting the number of pulses as said first flexible sheet moves from the open position to the edge of the document; and second means for counting the number of pulses as said second flexible sheet moves from the open position to the other edge of the document.

13. A printing machine according to claim 12, further including a registration guide mounted on said platen and adapted to engage mutually perpendicular edges of the document to position the document at the registration position on said platen.

14. A printing machine according to claim 13, wherein said calculating means determines the size of the document as a function of the distance that said first flexible sheet and said second flexible sheet move and the constant corresponding to the distance from the open position to said registration guide.

15. A method of determining the size of an original document positioned so that one set of perpendicular edges thereof are located at a registration position on a platen, including the steps of:

determining the distance between the registration position and a open position to calibrate the shutters and storing this information as a constant;

moving a shutter from the open position to another set perpendicular edges of the document;

measuring the distance that the shutter moves in moving from the open position to the edges of the document; and calculating the size of the document as a function of the distance measured during said step of measuring and a constant corresponding to the distance from the registration position on the platen to the open position.

16. A method according to claim 15, further includes the step of sensing edges of the document to position edges of the shutter adjacent thereto during said step of moving the shutter.

17. A method according to claim 16, further including the step of detecting that the shutter is at the open position.

18. A method according to claim 17, wherein said step of moving the shutter includes the steps of:

advancing a first flexible sheet across the platen from the open position until an edge thereof is adjacent one edge of the document; and advancing a second flexible sheet across the platen, in a direction substantially perpendicular to the direction of movement of the first flexible sheet, from the open position until one edge thereof is adjacent the other edge of the document.

19. A method according to claim 18, wherein said step of measuring includes;

counting the number of pulses as the first flexible sheet moves from the open position to the edge of the document; and counting the number of pulses as the second flexible sheet moves from the open position to the other edge of the document.

20. A method according to claim 19, further including the step of registering the original document against a guide mounted on the platen and so that mutually perpendicular edges of the document engage the guide to position the document at the registration position on the platen.

21. A method according to claim 20, wherein said step of calculating includes the step of determining the size of the document as function of the distance that the first flexible sheet and the second flexible sheet move and the constant corresponding to the distance from the open position to the registration guide.

22. A method of calibrating a shutter mounted movably on a platen adapted to support an original document thereon, including the steps of:

positioning an original document having a predetermined size on the platen so that one set of perpendicular edges thereof are located at a registration position;

moving the shutter from a open position to another set of perpendicular edges of the document;

measuring the distance that the shutter moves between the open position and the edges of the document; and calculating the distance between the open position and the registration position of the original document as a function of the distance measured during said step of measuring and the size of the original document.

23. A method according to claim 22, further including the step of sensing edges of the document to position edges of the shutter adjacent thereto during said step of moving the shutter.

24. A method according to claim 23, further including the step of detecting that the shutter is at the open position.

25. A method according to claim 24, wherein said step of moving the shutter includes the steps of:

advancing a first flexible sheet across the platen from the open position until an edge thereof is adjacent one edge of the document; and advancing a second flexible sheet across the platen, in a direction substantially perpendicular to the direction of movement of the first flexible sheet, from the open position until one edge thereof is adjacent the other edge of the document.

26. A method according to claim 25, wherein said step of measuring includes;

counting the number of pulses as the first flexible sheet moves from the open position to the edge of the document; and counting the number of pulses as the second flexible sheet moves from the open position to the other edge of the document.

27. A method according to claim 26, further including the step of registering the original document against a guide mounted on the platen so that mutually perpendicular edges of the document engage the guide to position the document at the registration position on the platen.

28. A method according to claim 27, wherein said step of calculating includes the step of determining the location of the open position as function of the distance that the first flexible sheet and the second flexible sheet move and the size of the original document.

* * * * *